US005248037A

United States Patent [19]

Kornberg et al.

[11] Patent Number: 5,248,037

[45] Date of Patent: Sep. 28, 1993

[54] DISPLAY BOX SIMULATING A BOOK

[75] Inventors: Grant C. Kornberg; John R. Supple, both of Durham, N.C.; Michael D. Priore, Brooklyn, N.Y.

[73] Assignee: Largely Literary Designs, Inc., Durham, N.C.

[21] Appl. No.: 924,175

[22] Filed: Aug. 3, 1992

[51] Int. Cl.[5] ..... B65D 5/10

[52] U.S. Cl. ..... 206/457; D9/326; 206/472; 229/8; 229/153

[58] Field of Search ..... D3/35, 66, 79; D9/322, D9/326, 414, 418, 420, 433; 206/232, 311, 387, 444, 472–475, 457, 459.5; 229/8, 153

[56] References Cited

U.S. PATENT DOCUMENTS

| | | | |
|---|---|---|---|
| D. 81,941 | 9/1930 | Ross | D9/326 |
| D. 85,913 | 1/1932 | Cawood | D9/326 |
| D. 152,523 | 2/1949 | Duncan et al. | D9/326 |
| 676,756 | 6/1901 | Miller | 206/457 |
| 812,212 | 2/1906 | Landrum | 206/472 |
| 1,103,708 | 7/1914 | Thumb | 229/153 |
| 1,996,975 | 4/1935 | Raisin | 229/8 |
| 2,197,152 | 4/1940 | Mason | 229/8 |
| 2,387,790 | 10/1945 | Williamson | 229/8 |
| 3,176,899 | 4/1965 | McMahon | 229/162 |
| 4,717,021 | 1/1988 | Ditzig | 206/444 |
| 4,925,027 | 5/1990 | Roze | 206/387 |

OTHER PUBLICATIONS

Photographs of Itty Bitty Book Light product package.

*Primary Examiner*—Jimmy G. Foster
*Attorney, Agent, or Firm*—Olive & Olive

[57] ABSTRACT

A display box simulating a book is assembled from a blank having score lines to define a box having a generally rectangular cross-section and capable of enclosing contents within the box. The box of the invention has a front panel, a spine panel, a side panel opposite the spine, a rear panel, a top panel, and a bottom panel, all having outside surfaces on which appear graphic representations simulating respectively the front cover, the spine, the side opposite the spine, the rear cover, the top and the bottom of a closed book. The front panel of the box of the invention preferably is formed with a display window through which the contents of the box are visible.

6 Claims, 2 Drawing Sheets

DISPLAY BOX SIMULATING A BOOK

BACKGROUND OF THE INVENTION

1. Field of the Invention

The invention relates to box packaging, and more particularly to a display box which simulates a book and preferably provides a display window through which the contents of the box are visible.

2. Description of the Related Art

Numerous variants of box packaging are in existence. Several patents exist for boxes having a face with an aperture, for example, the carton having two covers of Mori et. al. (U.S. Pat. No. 3,835,989), the display box of Richardson et. al. (U.S. Pat. No. 4,285,150), the folding carton of Zeitter (U.S. Pat. No. 3,870,221), and the window carton of Buttery (U.S. Pat. No. 3,835,988), each incorporated herein by this reference. While these cartons provide an aperture, the cartons disclosed do not simulate books and cannot be stacked and stored like books.

A number of cartons appear on the market which contain objects, e.g., gloves and undergarments, that are visible through apertures. These cartons, however, do not simulate books in the way they appear individually, or when stacked and on display.

Folding blanks also exist which are constructed to simulate some object, for example, the locking assembly of Growney (U.S. Pat. No. 3,835,987) and the vehicle simulating display of Mayhew (U.S. Pat. No. 4,055,250), also both incorporated herein by this reference. While the carton of Growney is constructed to resemble a book, its construction does not allow it to function as a packaging display and carton for soft goods, but rather the carton disclosed by the Growney patent primarily functions to open and close in a book-like fashion and hide the contained object until the carton is opened. The Growney carton provides only a small hollow portion for receiving an object. The packaging of The ITTY BITTY TM book light of Zelco Industries, Inc. is structured to have a book-like appearance but like the Growney carton has a front which opens and closes like the front cover of a book.

Book stores which sell, or would like to sell, goods other than books particularly have a need for a display box which simulates a book. Book stores typically do not have the space or appropriate display racks for displaying goods for sale other than books, for example t-shirts or sweatshirts.

The display box of the invention permits book stores to utilize existing limited display areas (e.g., shelves) to display soft goods while still maintaining a book store decor and a book store theme.

It is an advantage and object of the invention that the display box simulates a book in appearance and in the manner in which the packaging rests on a book shelf.

Another advantage of the invention is that the display box permits its contents to be viewed through a display window.

It is a further advantage of the invention that the display box is suitable for book stores for use in existing sale display space and fits into the decor of a book store.

Other aspects and features of the invention will be more fully apparent from the following disclosure and appended claims.

SUMMARY OF THE INVENTION

The display box of the invention is constructed from a blank having generally a front panel, a back panel, a top panel, a bottom panel, a side panel and a spine panel which are foldably connected to form a box having a generally rectangular cross-section. The panels of the display box of the invention are sized and proportioned so that the display box formed from the blank is capable of sitting on a bookshelf like a book. The outside surfaces of the panels are printed to simulate the appearance of a book. The outside surface of the front panel of the display box of the invention simulates the front cover of a book and preferably contains a display window through which the contents of the box are visible. The outside surface of the rear panel simulates the back cover of a book.

The spine panel is foldably connected to the front and rear panels of the display box. The outside surface of the spine panel simulates the spine of a book on which the contents of the box may be textually represented as a title and presented as if it were the title of a book. The side panel is foldably connected to the front and rear panels and resides opposite to the spine panel. The outside surface of the side panel simulates the side view of a closed book by graphically representing the edges of pages between the front and back covers of a closed book. Similarly the outside surfaces of the top and bottom panels simulate respectively the top and bottom views of a closed book, by graphically representing the edges of pages between a closed book cover.

DETAILED DESCRIPTION OF THE INVENTION AND PREFERRED EMBODIMENTS THEREOF

Figure 1:
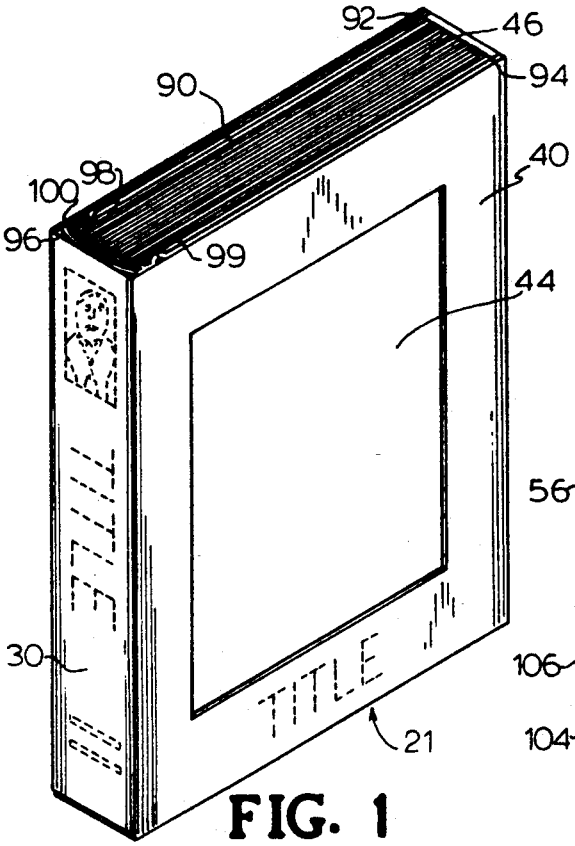
FIG. 1 is a front perspective view of an erected display box of the invention and with a title and other graphic designs shown in dashed lines.
Figure 2:
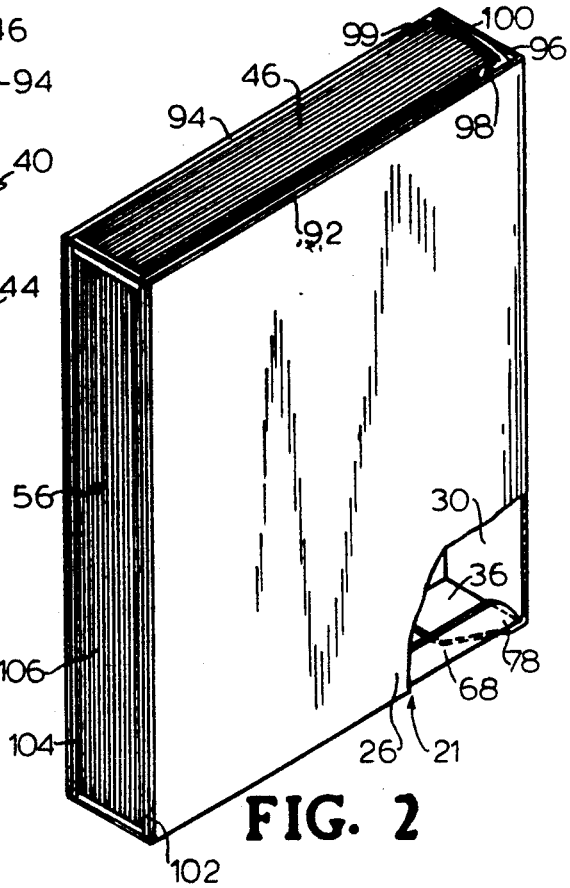
FIG. 2 is a rear perspective view of the display box shown in FIG. 1 showing a partial cut-away portion.
Figure 4:
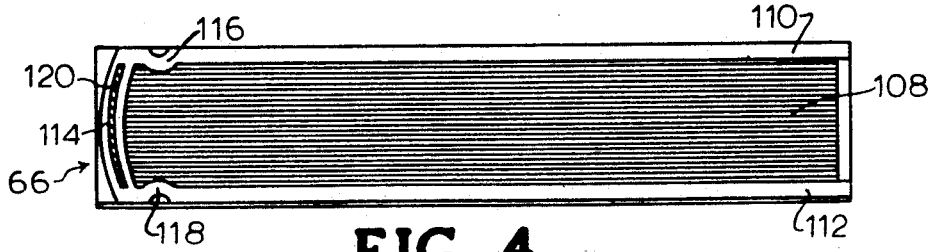
FIG. 4 is a bottom view of the display box shown in FIG. 1.
Figure 5:
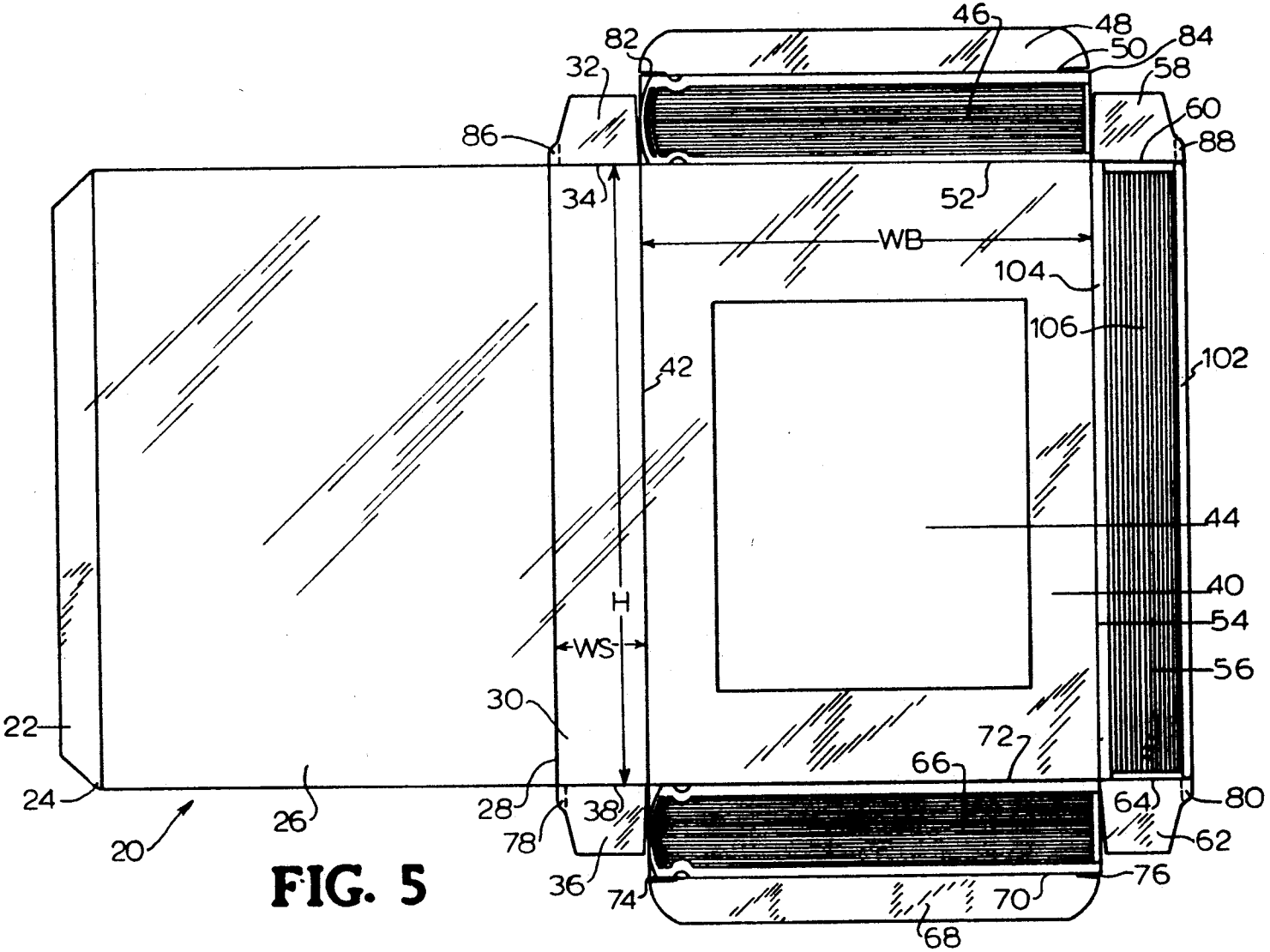
FIG. 5 is a top plan view of the outside surface of a blank from which the display box of the invention is erected.

In general, the erected display box 21 of the invention, shown in FIGS. 1 and 2, has a front panel 40, a rear panel 26, a top panel 46, a bottom panel 66 (as shown in FIG. 4), a spine panel 30, and a side panel 56 which in the completed box 21 resides opposite the spine panel 30 all of which panels are formed as part of the blank 20, shown in FIG. 5, from which the display box 2 of the invention is made. Additionally, in the Figures, the panels in blank 20 and the outside surfaces of the panels in display box 21 are referred to by the same numbers, for example, "spine panel 30" in blank 20 is assigned the same number, "spine panel 30," in display box 21. In the description, the term "height H" refers to the distance from the bottom of the display box 21 to the top of the display box 21 along the length of the spine panel 30 as illustrated in FIG. 5. The term "spine width WS" refers to the distance between the front panel and the rear panel of the erected display box 21 as shown in FIG. 5. The term "box width WB" refers to the distance measured across the front panel 40 at a right angle to the height H as shown in FIG. 5.

Referring next to FIG. 5, the display box 21 of the invention is erected from blank 20 such that when blank 20 is folded and assembled it forms the display box 21 of the invention. Blank 20 is cut by conventional techniques from a unitary piece of any suitable substantially rigid material which is flexible and capable of being folded such as, for example, paper or cardboard, or plastic coated paper. Blank 20 is configured so as to fold up in such a way that only one surface, e.g. the outside surface, of blank 20 becomes the outside, visible surface of display box 21. In this manner graphic representations need only be printed on one surface of blank 20. The outside surface of blank 20 thus corresponds to the visible surfaces of display box 21 when assembled from blank 20 and displayed. The inside surface of blank 20 is not shown in FIG. 5 but is the mirror image of the outside surface except that it does not have a book-simulating appearance.

Rear panel 26 of blank 20, shown in FIG. 5, is foldably connected to side flap 22 along a first vertical edge defined by vertical score line 24, and to spine panel 30 along a second vertical edge defined by vertical score line 28. Spine panel 30 is foldably connected to top spine tab 32 along horizontal score line 34. The portion of top spine tab 32 adjacent to spine panel 30 along horizontal score line 34 is equal in width to the spine width WS. Top spine tab 32 has a narrower portion oppositely disposed to spine panel 30 and forms lip 86 which is adjacent to spine panel 30 and extends therefrom as indicated by the dashed line shown on tab 32 in FIG. 5. Similarly, spine panel 30 is foldably connected to bottom spine tab 36 along horizontal score line 38. A portion of bottom spine tab 36 is adjacent to spine panel 30 along score line 38 and is equal in spine width WS. Bottom spine tab 36 has a narrower portion oppositely disposed to spine panel 30 to form lip 78 which is adjacent to spine panel 30 and extends therefrom as indicated by the dashed line shown on tab 36 in FIG. 5.

Spine panel 30 is also foldably connected to front panel 40 along a first vertical edge of front panel 40 defined by vertical score line 42. Front panel 40 is foldably connected to top panel 46 along a first horizontal edge defined by horizontal score line 52. Top panel 46 is foldably connected along horizontal score line 50 to top closure flap 48. Slits 82 and 84 are cut into the ends of and along horizontal score line 50, and are slightly longer in length than lips 86 and 88 when lips 86 and 88 are measured outwardly from horizontal score lines 34 and 38 respectively.

Front panel 40 is also foldably connected to bottom panel 66 along a second horizontal edge defined by horizontal score line 72. Bottom panel 66 is foldably connected along horizontal score line 70 to bottom closure flap 68. Slits 74 and 76 are cut into the ends of and along horizontal score line 70, and are slightly longer in length than lips 78 and 80 when lips 78 and 80 are measured outwardly from horizontal score lines 38 and 64 respectively.

Front panel 40 is foldably connected along a second vertical edge defined by vertical score line 54 to side panel 56. Side panel 56 is foldably connected along horizontal score line 60 to top tab 58. The portion of top tab 58 adjacent to side panel 56 is equal in width to the width of side panel 56, which is also equal to spine width WS. Top tab 58 has a narrower portion oppositely disposed to side panel 56 to form lip 88 which is adjacent to side panel 56 and extends from the outermost vertical edge of side panel 56, as indicated by the dashed line on tab 58 in FIG. 5. Side panel 56 is foldably connected to bottom tab 62 along horizontal score line 64. The portion of bottom tab 62 adjacent to side panel 56 is equal in width to the width of side panel 56. Bottom tab 62 has a narrower portion oppositely disposed to side panel 56 to form lip 80 which is adjacent to side panel 56 and extends from the outermost vertical edge of side panel 56, indicated by the dashed line on tab 62 in FIG. 5.

Display window 44 is generally centrally provided in front panel 40, and is preferably large enough to display the contents of the display box 21 without significantly weakening the structure. Display window 44 may be covered with a transparent material, such as cellophane or polyethylene film, which is attached to the inside surface of front panel 40 so that the contents of display box 21 are protected while remaining visible. Other ways to protect the contents of display box 21 are to shrink-wrap the entire box so that both the box and its contents are covered and sealed with a transparent material, or the product inside may be protectively wrapped and then placed in display box 21.

To erect and assemble blank 20, side flap 22 is folded inwardly (toward the inside surface of blank 20) along vertical score line 24 at a right angle to rear panel 26; rear panel 26 is folded inwardly along vertical score line 28 at a right angle to spine panel 30; spine panel 30 is folded inwardly along vertical score line 42 at a right angle to front panel 40; and front panel 40 is folded inwardly along vertical score line 54 at a right angle to side panel 56. The inside surface of side panel 56 is secured to the outside surface of side flap 22 such that the outermost vertical edge of side panel 56 is approximately adjacent to score line 24 when side panel 56 is secured to side flap 22. Any securing means conventionally known in the art may be utilized to secure side panel 56 to side flap 22, such as the use of an adhesive, an adhesive strip, or staples. A method which permits the securing means to be hidden from the outside surface of display box 21 is preferred, for example, a hot melt or an adhesive or the like. When side panel 56 is secured to side flap 22, the partially erected blank 20 forms a tubular structure with a generally rectangular cross-section, not shown.

To close the bottom of partially erected blank 20, bottom tabs 36 and 62 are folded inwardly (toward the inside surface of blank 20) along horizontal score lines 38 and 64 respectively, at approximately right angles. Bottom closure flap 68 is folded inwardly toward bottom panel 66 along horizontal score line 70 to form approximately a right angle. Bottom panel 66 is folded inwardly at a right angle toward front panel 40 along horizontal score line 72 such that the outside surface of bottom closure flap 68 abuts the bottom inside surface of rear panel 26. When the bottom of display box 21 is fully closed, shown in FIG. 4 and in partial cut-away view in FIG. 2, lips 78 and 80 are inserted into slots 74 and 76 respectively. Lips 78 and 80, once inserted into slits 74 and 76 respectively, serve to retain bottom closure flap 68 and bottom panel 66 in a closed position in the display box 21. A bottom view of the closed bottom of display box 21 is illustrated in FIG. 4.

Figure 3:
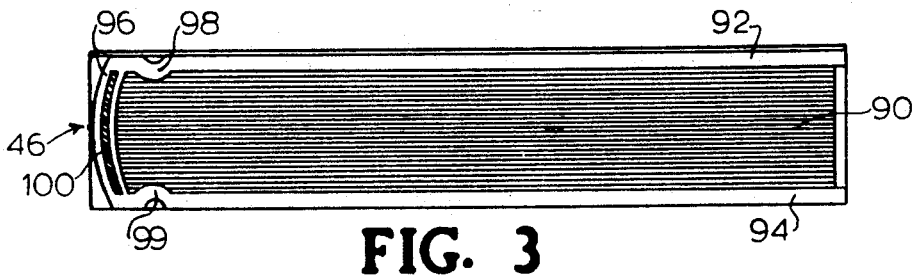
FIG. 3 is a top plan view of the display box shown in FIG. 1.

Similarly, the top of display box 21 is closed by folding top tabs 32 and 58 inwardly at right angles along horizontal score lines 34 and 60 respectively. Top closure flap 48 is folded inwardly at a right angle toward top panel 46 along horizontal score line 50. Top panel 46 is folded inwardly at a right angle toward front panel 40 along horizontal score line 52 such that the outside surface of top closure flap 48 abuts the top inside surface of rear panel 26. When the top of display box 21 is fully closed, lips 86 and 88 are inserted into slits 82 and 84 respectively, in a same manner that the bottom of the display box 21 closes as illustrated in the partial cutaway view in FIG. 2. Lips 86 and 88, once inserted into slits 82 and 84 respectively, serve to retain top closure flap 48 and top panel 46 in a closed position in the display box 21. A top view of the closed top of display box 21 is illustrated in FIG. 3. Prior to final assembly the contents of display box 21 are inserted into display box 21 through either opened top panel 46 or opened bottom panel 66.

The fully erected and closed display box 21 of the invention is shown in front perspective view in FIG. 1, and in rear perspective view in FIG. 2. When display box 21 is in an upright position as shown in FIGS. 1 and 2, top panel 46 is adjacent to and at a right angle to the top portions of spine panel 30, front panel 40, side panel 56 and rear panel 26. Similarly, bottom panel 66 is adjacent to and at a right angle to the bottom portions of spine panel 30, front panel 40, side panel 56 and rear panel 26 when blank 20 is formed into display box 21.

In appearance and size, display box 21 simulates a book. A typical book has generally a front cover, a spine, a back cover, an unbound opening side, a top and a bottom. The pages of a book are typically bound together by a binding along the spine of the book. The front and back covers of a book, particularly the front and back covers of a hard back book, are thicker than the individual pages of the book. The title of a book is generally printed along the spine, and often on the front cover of the book. The display box 21 of the invention simulates these characteristics of a book. While the display box 21 of the invention is described as simulating a closed book, it is recognized that variations to display box 21 may be made so that display box 21 simulates an open, or partially open, book while still remaining within the scope and spirit of the invention.

Just as the dimensions of books vary, the dimensions of the display box 21 may vary. Generally, however, the spine width WS, shown in FIG. 5, of display box 21 is less than or equal to the height H of display box 21, and the spine width WS is generally less than the box width WB. The outside surfaces of display box 21 graphically depict the corresponding surfaces of a closed book. Generally, in display box 21, the outside surface of front panel 40 simulates the front cover of a closed book; the outside surface of spine panel 30 simulates the spine of a closed book; the outside surface of rear panel 26 simulates the back cover of a closed book; the outside surface of side panel 56 simulates the side surface of a closed book opposite the spine which is the unbound and opening side of the book; the outside surfaces of top panel 46 and bottom panel 66 simulate respectively the top and bottom views of a closed book.

The specific manner in which display box 21 simulates a book will now be discussed. The outside surface of front panel 40 of display box 21 contains textual and/or graphic matter in the same manner that textual and graphic printing appears on the front cover of a book. Preferably, the contents of display box 21 are given a "title" which may be printed on front panel 40, as illustrated in FIG. 1. In addition, the contents of display box 21 are preferably visible through display window 44 of front panel 40. If the contents of display box 21 contain printed matter, for example, pictorial or textual matter on soft goods, portions of that printed matter preferably appears through display window 44.

The outside surface of spine panel 30 also contains graphics and/or textual matter in the same manner that printing appears on the spine of a book. The "title" is printed on the outside surface of spine panel 30, preferably so that the printing reads from the top of spine panel 30 to the bottom of spine panel 30 as would the printed title on the spine of a book as illustrated in FIG. 1. The "title" may also be printed horizontally across the spine width. A pictorial representation of the contents of display box 21 may appear on the outside surface of spine panel 30, as illustrated in FIG. 1. Other graphic designs may also appear on the outside surface of spine panel 30, for example, horizontal lines across the spine width, as shown in FIG. 1, are a common graphic design on the spines of books. The outside surface of rear panel 26 also contains graphic representations and textual material, for example, summary information of the contents (not shown).

The outside surfaces of top panel 46, side panel 56 and bottom panel 66 simulate respectively the top, side and bottom views of a closed book by presenting graphic representations of the visible features of a closed book, as shown in FIGS. 1 through 4. The features depicted on the panels 46, 56 and 66 are not structural features, but rather are graphic or pictorial representations of features of a book.

In general, the outside surface of top panel 46, shown in top view in FIG. 3, simulates the top view of a closed book by presenting graphic representations of the front and back covers, the binding, and the pages of a book, shown also in FIGS. 1 and 2. Simulated front cover edge 94 is a representation of the top edge of a front cover of a closed book; simulated back cover edge 92 represents the top edge of a back cover of a closed book. Edges 92 and 94 are parallel and oppositely disposed along the long sides of top panel 46. Additionally, the outside surface of top panel 46 contains a graphic representation of a simulated spine cover edge 96 along the portion of top panel 46 which meets spine panel 30 at a right angle in the closed display box 21, as illustrated in FIG. 1. Spine cover edge 96 extends along top panel 46 between edges 92 and 94 and curves away slightly from spine panel 30. Edges 92 and 94 join spine cover edge 96 at curved portions 98 and 99 respectively. Simulated binding 100 is centrally placed within the space defined by spine cover edge 96, and is similar in shape and slightly smaller than spine cover edge 96. Binding 100 simulates the top view of the binding of a book.

Graphic representations of the top edges of pages, indicated as pages 90, are between and parallel to back cover edge 92 and front cover edge 94. The simulated pages 90 extend along top panel 46 from a first end at spine cover edge 96 to a second end slightly inward from the ends of edges 92 and 94, and slightly inward from the edge of top panel 46 where top panel 46 meets side panel 56 at a right angle in closed display box 21. Edges 92, 94 and 96, and curved portions 98 and 99 are preferably wider than the simulated pages 90 to simulate the top view of closed book wherein the edges of the book cover are thicker than the individual book pages. Together simulated cover edges 92, 94, 96, simulated curved portions 98 and 99, simulated pages 90 and simulated binding 100, simulate the top view of a closed book.

Similarly, bottom panel 66, FIG. 4, simulates the bottom view of a closed book. Bottom panel 66 is provided with a depiction of a simulated back cover edge 112 and a simulated front cover edge 110 which are parallel and oppositely disposed along the long sides of bottom panel 66. A graphic representation of a simulated spine cover edge 114 is presented along the portion of bottom panel 66 which meets spine panel 30 at a right angle in closed display box 21. Spine cover edge 114 generally extends along the edge of bottom panel 66 adjacent to spine panel 30 between edges 110 and 112, and curves away from spine panel 30 slightly. Edges 110 and 112 join spine cover edge 114 at curved portions 116 and 118, respectively, as shown in FIG. 4. Simulated binding 120 is similar and is centrally placed within the space defined by spine cover edge 114, and is similar in shape and size to spine cover edge 114. Binding 120 simulates the bottom view of the binding of a book.

Bottom panel 66 is provided with graphic representations of the edges of pages, indicated as simulated pages 108, between and parallel to front cover edge 110 and back cover edge 112. Pages 108 simulate the closed pages of a book from a bottom view. Pages 108 begin at a first end at binding 120 and extend to a second end slightly inward from the ends of edges 110 and 112, and from the portion of bottom panel 66 which is adjacent and at a right angle to side panel 56 in the closed display box 21. Edges 110, 112 and 114, and curved portions 116 and 118 are preferably wider than pages 108 to simulate the bottom view of a closed book. Together simulated cover edges 110, 112, and 114, curved portions 116 and 118, pages 108, and binding 120, simulate the bottom view of a closed book.

Side panel 56 simulates the side surface of a closed book which surface corresponds to the unbound, opening side of a closed book opposite the spine. Side panel 56 is provided with a simulated front cover edge 104, shown in FIGS. 2 and 5, and a simulated back cover edge 102 which extend in parallel fashion along opposing long edges of side panel 56, extending essentially the same height as the display box 21. Side panel 56 is provided with simulated pages 106 between and parallel to front cover edge 104 and back cover edge 102. Pages 106 extend the height of side panel 56 between front cover edge 104 and back cover edge 102 from a point slightly below the top of side panel 56 to a point slightly above the bottom of side panel 56. Edges 102 and 104 are preferably wider than pages 106 to simulate the front and back covers of a book. Together simulated edges 102 and 104 and simulated pages 106 simulate a closed book from the side view opposite the spine.

Display box 21 of the invention is stackable on book shelves in the same manner as a book is placed on a book shelf, i.e., in upright position. For this purpose, the bottom panel 66 rests on the shelf so that the spine panel 30 faces outward from the shelf and the title on spine panel 30 is visible and readable in the manner that a title of a book on a bookshelf is readable, as illustrated in FIG. 1. When display box 21 is stored and displayed in this manner, display box 21 simulates a book on a book shelf. This display technique is especially useful for book stores which have limited areas and limited types of storage and display space.

It is sometimes necessary or desirable to stack books flat or on an end other than in upright position. The display box 21 readily meets this need in that it is stackable on any face, and may contain printed matter on top panel 46 or bottom panel 66, for example, so that the contents of display box 21 can be identified from box portions other than the spine panel 30, front panel 40 or rear panel 26.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A display box simulating the appearance of a closed book, comprising:

a. a substantially rectangular front panel having an outside surface simulating in appearance the outside appearance of a front cover of a book, said front panel extending between first and second vertical edges and first and second horizontal edges, said front panel having a display window positioned on said front panel through which window the contents contained in the display box are visible;

b. a substantially rectangular spine panel foldably connected to the front panel along said first vertical edge and having an outside surface simulating in appearance the outside appearance of a spine of a book, said spine panel extending between said first vertical edge and a third vertical edge;

c. a substantially rectangular side panel foldably connected to the front panel along said second vertical edge and having an outside surface simulating in appearance the outside appearance of a side of a closed book opposite the spine, said side panel extending between said second vertical edge and a fourth vertical edge;

d. a substantially rectangular rear panel extending between said third vertical edge and a fifth vertical edge and foldably connected to the spine panel along said third vertical edge and connected to the side panel by joining of said fourth and fifth vertical edges, said rear panel having an outside surface simulating in appearance the outside appearance of a back cover of a book;

e. a substantially rectangular top panel foldably connected to the front panel along its first horizontal edge and having an outside surface simulating in appearance the outside appearance of a top of a closed book;

f. a substantially rectangular bottom panel foldably connected to the front panel along said second horizontal edge and having an outside surface simulating in appearance the outside appearance of a bottom of a closed book; and g. said spine panel, side panel, rear panel, top panel and bottom panel including means for releasably securing said panels and enabling said panels to be assembled together to form a hollow closeable display box of rectangular horizontal and vertical cross section for storing a selected product therein while simultaneously presenting the appearance, irrespective of the nature of the product, of a closed book, said means for releasably securing said panels comprising:

i. a plurality of cooperative flap portions, each of said flap portions being connected at a score line to a panel selected from the group of panels consisting of said spine panel, side panel, rear panel, top panel and bottom panel; and ii. a plurality of slits, each of said slits being positioned at an end of a selected score line.

2. The display box according to claim 1 wherein the outside surface of the side panel simulates a side edge of the front cover of a closed book, a side edge of the back cover of a closed book, and side edges of a plurality of pages between the front and back covers of a closed book; wherein the outside surface of the top panel simulates a top edge of the front cover of a closed book, a top edge of the back cover of a closed book, and top edges of a plurality of pages between the front and back covers of a closed book; and wherein the outside surface of the bottom panel simulates a bottom edge of the front cover of a closed book, a bottom edge of the back cover of a closed book, and bottom edges of a plurality of pages between the front and back covers of a closed book.

3. The display box according to claim 2 wherein the outside surface of the top panel further comprises a binding edge which simulates a top edge of the binding of a closed book, and wherein the outside surface of the bottom panel further comprises a binding edge which simulates a bottom edge of the binding of a closed book.

4. The display box according to claim 3 further comprising a title printed on the spine panel and representing the contents of the display box.

5. The display box according to claim 4 wherein the width of the spine panel is less than the height of the spine panel, and the width of the spine panel is less than the width of the front panel.

6. The display box according to claim 1, wherein flap portions are positioned at:

a. a score line on said rear panel at said fifth vertical edge;

b. a score line on a third horizontal edge of said top panel opposite and parallel to said first horizontal edge, wherein slits are positioned at ends of said third horizontal edge;

c. a score line on a fourth horizontal edge of said bottom panel opposite and parallel to said second horizontal edge, wherein slits are positioned at ends of said fourth horizontal edge;

d. score lines on two edges of said spine panel which are perpendicular to and extend between said first and third vertical edges; and e. score lines on two edges of said side panel which are perpendicular to said second vertical edge.

* * * * *